US008695703B2

(12) United States Patent
Dinariev et al.

(10) Patent No.: US 8,695,703 B2
(45) Date of Patent: Apr. 15, 2014

(54) METHOD FOR MONITORING FLOOD FRONT MOVEMENT DURING FLOODING OF SUBSURFACE FORMATIONS

(75) Inventors: Oleg Yurievich Dinariev, Moscow (RU); Vladimir Vasilievich Tertychnyi, Moscow (RU); Dimitri Vladilenovich Pissarenko, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 468 days.

(21) Appl. No.: 12/990,080

(22) PCT Filed: Apr. 28, 2008

(86) PCT No.: PCT/RU2008/000267
§ 371 (c)(1),
(2), (4) Date: Jan. 14, 2011

(87) PCT Pub. No.: WO2009/134158
PCT Pub. Date: Nov. 5, 2009

(65) Prior Publication Data
US 2011/0100632 A1 May 5, 2011

(51) Int. Cl.
*E21B 47/10* (2012.01)

(52) U.S. Cl.
USPC ..... 166/252.4; 166/401

(58) Field of Classification Search
USPC ..... 166/250.03, 252.4
See application file for complete search history.

(56) References Cited

U.S. PATENT DOCUMENTS

| | | | | |
|---|---|---|---|---|
| 3,599,715 | A | 8/1971 | Roszelle | |
| 3,874,451 | A | 4/1975 | Jones et al. | |
| 4,085,798 | A | 4/1978 | Schweitzer et al. | |
| 4,319,635 | A * | 3/1982 | Jones | 166/401 |
| 6,886,632 | B2 * | 5/2005 | Raghuraman et al. | 166/252.4 |
| 7,784,539 | B2 * | 8/2010 | Montaron | 166/252.4 |
| 2008/0006410 | A1 * | 1/2008 | Looney et al. | 166/308.4 |

FOREIGN PATENT DOCUMENTS

| | | | |
|---|---|---|---|
| CA | 2288784 | A1 | 11/1998 |
| RU | 2266396 | C2 | 12/2005 |
| SU | 1017794 | A | 5/1983 |
| SU | 1130689 | A | 12/1984 |

OTHER PUBLICATIONS

International Search Report and Written Opinion of PCT Application No. PCT/RU2008/000267 dated Jan. 15, 2009: pp. 1-5.
Examination Report of Canadian Application No. 2,722,838 dated Aug. 7, 2012: pp. 1-3.

* cited by examiner

*Primary Examiner* — George Suchfield

(57) ABSTRACT

This invention relates generally to methods for monitoring directional flood front movement during oil recovery and more specifically to methods for monitoring flood front movement of flooding agent injected into subsurface formations. The method comprises detecting physical properties of subsurface formation and injection of a flooding agent into said formation through at least one injection well thus forcing reservoir oil movement toward at least one production well. The flooding agent is a highly dispersed gas-liquid mixture having size of gas bubbles not exceeding an average diameter of the pores of said oil-bearing reservoir. The method further comprises detecting the same physical properties of the formation at the same area after flooding and monitoring the flood front profile by registrating changes in the physical properties of the formation caused by the arrival of said flood front.

6 Claims, 1 Drawing Sheet

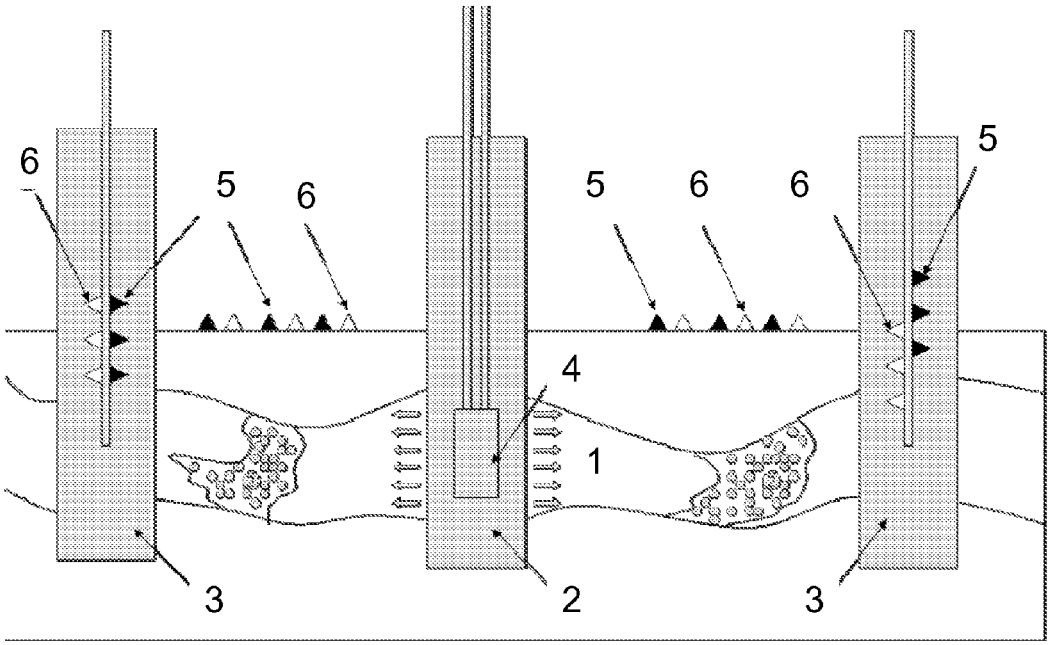
6
5
6
5
6
6
5
4
1
3
2
3

METHOD FOR MONITORING FLOOD FRONT MOVEMENT DURING FLOODING OF SUBSURFACE FORMATIONS

FIELD OF THE INVENTION

This invention relates generally to methods for monitoring directional flood front movement during oil recovery and more specifically to methods for monitoring flood front movement of flooding agent injected into subsurface formations.

The most widely used recovery technique is injection of a flooding agent, for example, water into an oil-bearing reservoir. As water moves through the reservoir, it acts to displace oil therein to a production system composed of one or more wells through which the oil is recovered.

Water flooding depends on the ability of injected water to displace the oil remaining in the reservoir. The effectiveness of water flooding is very much dependent on the hydrodynamic properties of the reservoir (permeability field, hydrodynamic connections, etc), which remain largely unknown during the whole production period.

In performing a flooding operation it is important to monitor the progress of the flood front to determine the movement thereof. Due to formation characteristics, the flood front does not move in uniform fashion from the injection wells toward the production well. Further, subsurface formations may contain high-permeability streaks which allow injected water to break through the oil into the production well. The result of such a breakthrough is the production from the well of water while significant oil may remain in the formations.

BACKGROUND ART

In the prior art, various methods have been utilized to monitor the progress of a flood front in oil recovery operations. The first is to track the amount of oil and water recovered in production wells and to compare that to the quantity of water being injected into the system. Then computer models are created which include known information about the formation being flooded. The disadvantage of only monitoring the flow rates is that if the formation is not homogeneous then valuable pockets of hydrocarbon might not be recovered.

The other method is disclosed in U.S. Pat. No. 3,874,451. It provides for the detection of the arrival of the flood front by monitoring the pressure change in boreholes. This method requires that the boreholes used for pressure monitoring must be uncased. In a production reservoir this can require the removal of casing already present in the boreholes or the drilling of new, uncased boreholes.

Then, U.S. Pat. No. 4,085,798, discloses a method for monitoring the flood front profile during water flooding by adding a tracer element having a characteristic gamma ray emission energy to the flood fluid. It is recognized as a serious disadvantage to be required to add tracer elements to the flood fluid prior to injection. Since this method is only directed to detecting elements in the injection fluid it does not provide an indication of flood front movement until the fluid flood front reaches or nearly reaches the monitor boreholes.

Accordingly, the present invention overcomes the deficiencies of the prior art by providing an environmentally friendly high resolution method for monitoring the flood front movement.

SUMMARY OF THE INVENTION

It is therefore an object of the invention to provide a method for monitoring a flood front movement through a subsurface formation located between at least one production well and at least one injection well during oil recovery operations comprising detecting physical properties of said formation, injection of a flooding agent into said formation through at least one injection well thus forcing reservoir oil movement toward at least one production well, the flooding agent being a highly dispersed gas-liquid mixture having size of gas bubbles not exceeding an average diameter of the pores of said oil-bearing reservoir, detecting the same physical properties of the formation at the same area after flooding and monitoring the flood front profile by registrating changes in the physical properties of the formation caused by the arrival of said flood front.

It is another object of the present invention to provide a method for monitoring the movement of a flood front through a subsurface formation comprising time lapse detecting of the physical properties of the formation by acoustic and/or by deep electromagnetic, and/or by gravimetric and/or by other means, which makes it possible to accurately monitor the flood front movement including detecting high-permeability zones and monitoring of the flood front profile.

It is a another object of the present invention to provide a method for monitoring the movement of a flood front in which time lapse detecting of the physical properties of the formation includes acoustic, electromagnetic or other fields induction by the sources located at the surface or/and in at least one well and registration of the signals y the receivers located at the surface or/and in the well.

It is another object of the present invention to provide a method for monitoring the movement of a flood front traveling through a subsurface formation wherein said physical properties include acoustic impedance and/or electric conductivity and/or magnetic permittivity.

It is a further object of present invention to provide a method for monitoring the movement of a flood front wherein there is a sequential injection of a highly dispersed gas-liquid mixture and conventional flooding agent without gas, so the gas bubbles can trace successive fluid fronts.

BRIEF DESCRIPTION OF THE DRAWINGS

FIG. 1 is a schematic diagram of an injection well and the production wells illustrating the monitoring of a flood front in accordance with the present invention.

DESCRIPTION OF THE PREFERRED EMBODIMENT OF THE INVENTION

Referring now to FIG. 1, there is illustrated a section of a subsurface porous formation 1 in which oil recovery is undertaken. The formation 1 is penetrated by at least one injection well 2 and the production wells 3. It should be understood that the number of injection wells and production wells illustrated is exemplary only, and that the actual number will differ in accordance with the size of the reservoir to undergo water flooding.

A dispergator 4, which produces a highly dispersed gas-liquid mixture having size of gas bubbles not exceeding an average diameter of the pores of said oil-bearing reservoir (for instance, $10^{-6}$ m), is located at the surface or in the wellbore of the injection wells used in a conventional way. Dispergator could operate continuously or in an operator specified regime. Highly dispersed gas-liquid mixture is injected into the permeable formation and propagates along the flow path in a porous media. The mixture can consist, for example, of water as a liquid and methane, nitrogen or other insoluble gas as a dispersed gas. The flood front expands radially from injection well 2 driving the oil in the producing formations toward producing wells 3. When the gas bubbles are sufficiently small (~micrometers or nanometers), they can survive as a dispersed phase inside liquid, while the gas-liquid mixture is propagating through the formation. Due to the contrast in physical properties between pure flooding fluids (water, polymer or others) and highly dispersed gas-liquid mixtures, time lapse monitoring of the changes in physical properties of the reservoir is possible with acoustic, electromagnetic or other fields induced by the sources 5 located at the surface or/and in the wells or naturally inside the reservoir and registered by the receivers 6 located at the surface or/and in the wells. Dynamic changes in physical properties registered by receivers 6 are caused by the movement of highly dispersed gas-liquid mixture. The receivers 6 can be located at the surface or in the wells. Thus, for example, the flood front changes such physical properties as acoustic impedance, electric conductivity and magnetic permittivity. The measurements are captured sequentially at the same area at different moments of time to monitor changes in the physical properties during the flooding operation. By establishing the time-series of physical properties detection the progress of the flood front through the formation can be monitored.

As an example, a typical procedure for 3D time-lapse seismic survey application could be considered as follows: (a) at a certain time after production start-up a 3D seismic is made in the vicinity of this well, (b) process data in a conventional manner to extract data of particular interest, e.g. amplitudes of seismic waves , travel times, maps, cubes, etc (c) inject high-dispersed water-gas mixture for duration of time, required to achieve the specified distance from the injection well, (d) run a 3D seismic at the same area to evaluate the difference in elastic field detected in step a) and interpretation results of step (b), (e) data of steps (a), (b) and (d) are used to extract information on the special distribution of the front which allow to reveal the information about the reservoir structure.

Size of the gas bubbles, distribution in space and over the time depends on peculiarities of the porous media and could be used as additional information about the reservoir properties. Monitoring of the changes in gas/oil ratio (GOR) in production wells provides information about the connectivity of the reservoir. The injection of gas-liquid mixture can be performed periodically (followed by usual water flooding), so the gas bubbles can trace successive water fronts.

Besides, this method can be applied for imaging inner rock structure and characterizing displacement process during the flow through the core in a lab.

While the invention has been described with respect to a preferred embodiments, those skilled in the art will devise other embodiments of this invention which do not depart from the scope of the invention as disclosed therein. Accordingly the scope of the invention should be limited only by the attached claims.

The invention claimed is:

1. A method for monitoring a flood front movement through a porous medium comprising detecting an electric conductivity or magnetic permittivity or both or their combination with acoustic impedance-of the medium, injecting a flooding agent into the medium, the flooding agent being a highly dispersed gas-liquid mixture having a size of gas bubbles not exceeding an average diameter of pores of said medium, detecting the electric conductivity or magnetic permittivity or both or their combination with acoustic impedance of the medium at the same area after flooding; and monitoring the flood front movement by registering changes in the electric conductivity or magnetic permittivity or both or their combination with acoustic impedance of the medium caused by an arrival of said flood front.

2. The method of claim 1, wherein the detection of electric conductivity or magnetic permittivity or both or their combination with acoustic impedance is made using one of acoustic, electromagnetic, and gravimetric receivers.

3. A method for monitoring flood front movement during flooding through a subsurface formation located between at least one production well and at least one injection well during oil recovery operations comprising:

detecting an electric conductivity or magnetic permittivity or both or their combination with acoustic impedance of said formation, injecting a flooding agent into said formation through the at least one injection well thus forcing reservoir oil movement toward the at least one production well, the flooding agent being a highly dispersed gas-liquid mixture having a size of gas bubbles not exceeding an average diameter of the pores of said formation, detecting the electric conductivity or magnetic permittivity or both or their combination with acoustic impedance of the formation at the same area after flooding, and monitoring the flood front movement by registering changes in the electric conductivity or magnetic permittivity or both or their combination with acoustic impedance of the formation caused by an arrival of said flood front.

4. The method of claim 3, wherein detecting the electric conductivity or magnetic permittivity or both or their combination with acoustic impedance of the formation is made by using one of acoustic, deep electromagnetic, and gravimetric receivers.

5. The method of claim 3, wherein detecting the electric conductivity or magnetic permittivity or both or their combination with acoustic impedance of the formation includes induction of at least one of acoustic and electromagnetic fields by a source located at a surface or in at least one well and registration of a signal by a receiver located at the surface or in at least one well.

6. The method of claim 3, comprising injecting a conventional flooding agent without gas after injecting the highly dispersed gas-liquid mixture.

* * * * *